US006260384B1

(12) United States Patent
Mino et al.

(10) Patent No.: US 6,260,384 B1
(45) Date of Patent: Jul. 17, 2001

(54) JEWELRY SETTING WITH A FACETED CAVITY

(76) Inventors: Kenneth L. Mino, 3770 Allison Ct., Wheat Ridge, CO (US) 80033; Thomas D. Kohl, 13895 Braun Rd., Golden, CO (US) 80401

( * ) Notice: Subject to any disclaimer, the term of this patent is extended or adjusted under 35 U.S.C. 154(b) by 0 days.

(21) Appl. No.: 09/276,950

(22) Filed: Mar. 26, 1999

(51) Int. Cl.[7] ..... A44C 17/02

(52) U.S. Cl. ..... 63/26; 63/27; D11/91; D11/92

(58) Field of Search ..... 63/26, 27, 29.1, 63/30; D11/91, 92

(56) References Cited

U.S. PATENT DOCUMENTS

| | | | | |
|---|---|---|---|---|
| D. 80,898 | * | 4/1930 | Kaufman | D11/92 |
| D. 195,690 | * | 7/1963 | Gibeault | D11/92 |
| 324,945 | * | 8/1885 | Lucas | 63/26 X |
| 529,611 | * | 11/1894 | Dittmer | 63/26 X |
| 832,887 | * | 10/1906 | Wittstein | 63/27 |
| 3,261,072 | * | 7/1966 | Stanley | 29/10 |
| 4,258,458 | * | 3/1981 | Danna | 63/27 X |
| 5,090,217 | * | 2/1992 | Beber et al. | 63/27 |
| 5,433,090 | * | 7/1995 | Santiago | 63/29.1 |
| 5,635,131 | | 6/1997 | Klotz et al. . | |
| 5,671,613 | | 9/1997 | Hoover et al. . | |

FOREIGN PATENT DOCUMENTS

| | | | | |
|---|---|---|---|---|
| 2306652 | * | 4/1975 | (FR) | 63/27 |

OTHER PUBLICATIONS

"Hoover & Strong Catalog 1998/99", *Hoover & Strong*, various pages, © 1998.

* cited by examiner

*Primary Examiner*—Anthony Knight
*Assistant Examiner*—Andrea Chop
(74) *Attorney, Agent, or Firm*—Dorsey & Whitney LLP

(57) ABSTRACT

A jewelry setting for securely holding a stone, such as a gem or a diamond, where the stone has at least one peripheral tip. The setting includes a base and a plurality of prongs. The prongs have an inclined portion extending from the base outwardly at an angle, and a vertical portion projecting vertically from the inclined portion. A cavity in one or more of the prongs positioned to receive the peripheral tip of the stone is stamped in the vertical portion of the prongs. The cavity has a plurality of faceted walls adapted such that when the peripheral tip of the stone is received in the cavity, the facets of the cavity engage the facets of the peripheral tip.

15 Claims, 7 Drawing Sheets

JEWELRY SETTING WITH A FACETED CAVITY

BACKGROUND OF THE INVENTION

1. Field of the Invention

This invention relates to jewelry, and more particularly to a setting structure for securely holding stones therein.

2. Description of Related Art

Jewelry settings are typically used to secure a precious or semi-precious stone, such as a gem or a diamond, to jewelry in a fashionable manner. Jewelry settings are often attached to rings, earrings, or other types of decorative accessories, and are generally made from gold, silver, or other metals and alloys well known in the art.

A jewelry setting typically includes a number of prongs converged at a base and extending outwardly at an angle. The prongs slope upward from the base, with the tips of the prongs defining an area above the base to hold a gem. To improve the retention of the gem in the prongs, it is known to drill a cavity in interior sides of select prongs. The drilled cavities are generally either semi-spherical or cone shaped, depending on the shape of the drill bit used. Alternatively, a C-shaped cavity can be formed on the interior side of the prong by drilling horizontally along the prong's interior side. The prong cavities act as seats and are typically positioned to grasp the tip of the gem. To secure the gem in the setting, the top of the prongs are pushed towards the setting base. This pivots the prongs at their point of contact with the gem, bending the upper portion of the prong downwardly, and thereby clasping down on the gem. As described below, there is a risk of breaking the tip of the stone from the concentrated force of the top of the cavity on the tip during this bending step. Once the prongs are bent towards the gem, the gem is set in place.

The placement of the prongs with respect to the gem generally depends on the location of the gem tips and edges. A gem may have one or more tips at various locations depending on the style of the gem's cut. For example, a marquise cut is an elongated oval shape, with tips at opposite ends of the gem's length. A pear cut is a style of cutting that resembles the outline of a pear, with a tip opposite the gem's bulb. A princess cut is a square cut, with four tips at the four corners of the gem. Typically, gem tips have a cubic or crystalline structure, with faceted sides coming together to form a point. Although a gem's size may change, the lattice angles of the tip will generally stay the same. Thus, for a particular style cut, a gem tip can change it proportion, but its basic shape usually stays the same.

One drawback of the customary jewelry settings described above is that the prong cavity walls typically do not correspond to the shape of a gem tip. The conventional cavities drilled in the prongs have either a rounded or conical cross sectional shape. A gem tip, on the other hand has faceted walls crystalline in shape. Thus, only the corners or the gem tip generally make contact with the cavity walls.

A consequence of ill-matching prong cavities and gem tips is a higher potential for tip breakage. A gem tip is secured in the jewelry setting by bending the prongs inwardly and squeezing the top and bottom walls of the prong cavities together. Prongs with poorly fitting cavities tend to concentrate the bending force at the gem tip's corners, where the gem sides engage the cavity walls. Because only a small area of the gem tip receives the prong bending force, a large amount of pressure is exerted on a small area of the gem tip. This pressure produces stress on the tip and may cause the gem tip to break. A broken gem tip usually requires the gem to be re-cut, decreasing the gem's size and value, and increasing its manufacturing costs.

Additionally, cavities incompatible with the shape of the gem tip can cause the gem to slip free from a jewelry setting more easily. As the prongs and their cavities endure temperature changes and shock from normal use, the gem loosens from the setting over time. With only a small area of the cavity walls in contact with the gem, there is a greater likelihood that the gem will fall out of its jewelry setting.

Another drawback to cavities drilled into the prongs of a jewelry setting can be an increased manufacturing cost in producing the jewelry setting. In order to drill a cavity into a prong, the setting must be fastened in position while a drill bit is used to form the cavity in the prong. Drilling consumes valuable machining time because it is difficult to properly insert the drill bit in the proper position. This increases the cost of creating the jewelry setting. In addition, jewelry settings may become ruined if the drill bit accidentally slips off the prong and drills at an unintended location on the setting.

Therefore, there exists a need for a jewelry setting which contains prong cavities conforming to the shape of gem tips. This will help keep a gem inside the jewelry setting more securely and reduce incidents of tip breakage when prongs are bent inwardly to clamp down on the gem. There also exists a need to produce a jewelry setting more easily and accurately. This will reduce the time, effort, and resultant scrap in the manufacture the jewelry setting.

SUMMARY OF THE INVENTION

In light of the above, therefore, according to a broad aspect of the invention, a jewelry setting for seating a stone having at least one peripheral tip is disclosed. The jewelry setting includes a base, a number of prongs branching outwardly from the base, and a cavity in at least one of the prongs. The cavity has a plurality of faceted walls adapted to receive the peripheral tip of the stone.

The jewelry setting may also include a chamfered outer corner at a top portion of at least one of the prongs. The peripheral tip may have facets, and the cavity defines facets adapted such that when the tip is received in the cavity, the facets of the cavity engage the facets of the tip.

The jewelry setting may also include a portion of the cavity which is rounded. The rounded portion of the cavity may be cylindrical, conical, or frustoconical in shape.

According to a different feature of the invention, the jewelry setting has a base and a plurality of prongs. The prongs have an inclined portion extending from the base outwardly at an angle, and a vertical portion projecting vertically from the inclined portion. A cavity is formed in one or more of the prongs having a plurality of faceted walls for receiving a peripheral tip of the stone. The cavity is positioned in part on the inclined portion and in part on the vertical portion of the prongs.

The foregoing and other features, utilities, and advantages of the invention will be apparent from the following more particular description of the preferred embodiment of the invention as illustrated in the accompanying drawings and as defined by the appended claims.

DETAILED DESCRIPTION OF THE INVENTION

Figure 1:
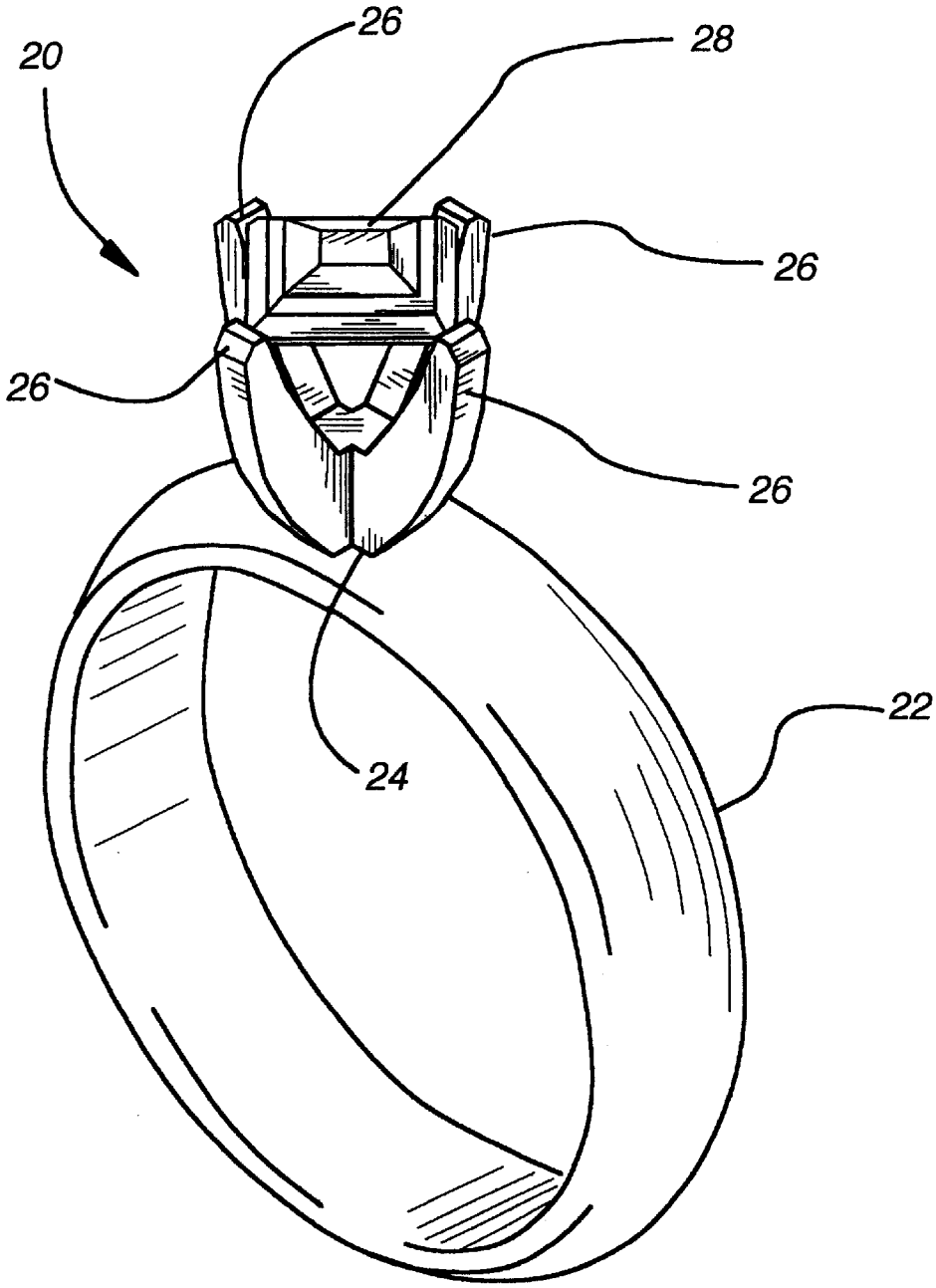
FIG. 1 is an isometric view of a jewelry setting of a ring according to the present invention.

FIG. 1 shows one embodiment of the jewelry setting 20 of the present invention mounted on a ring 22. The jewelry setting 20 can be made of gold, silver, platinum, palladium, or other materials known in the art. The jewelry setting 20 includes a base portion 24 attached to the ring 22 using any method known in the art, such as soldering. Several tip prongs 26 branch outwardly at an angle from the base 24. A gem 28 or other type of stone is placed inside an area above the base formed by the tops of the tip prongs 26. The tip prongs 26 secure the gem 28 to the setting 20 in an ornamental fashion.

Figure 2:
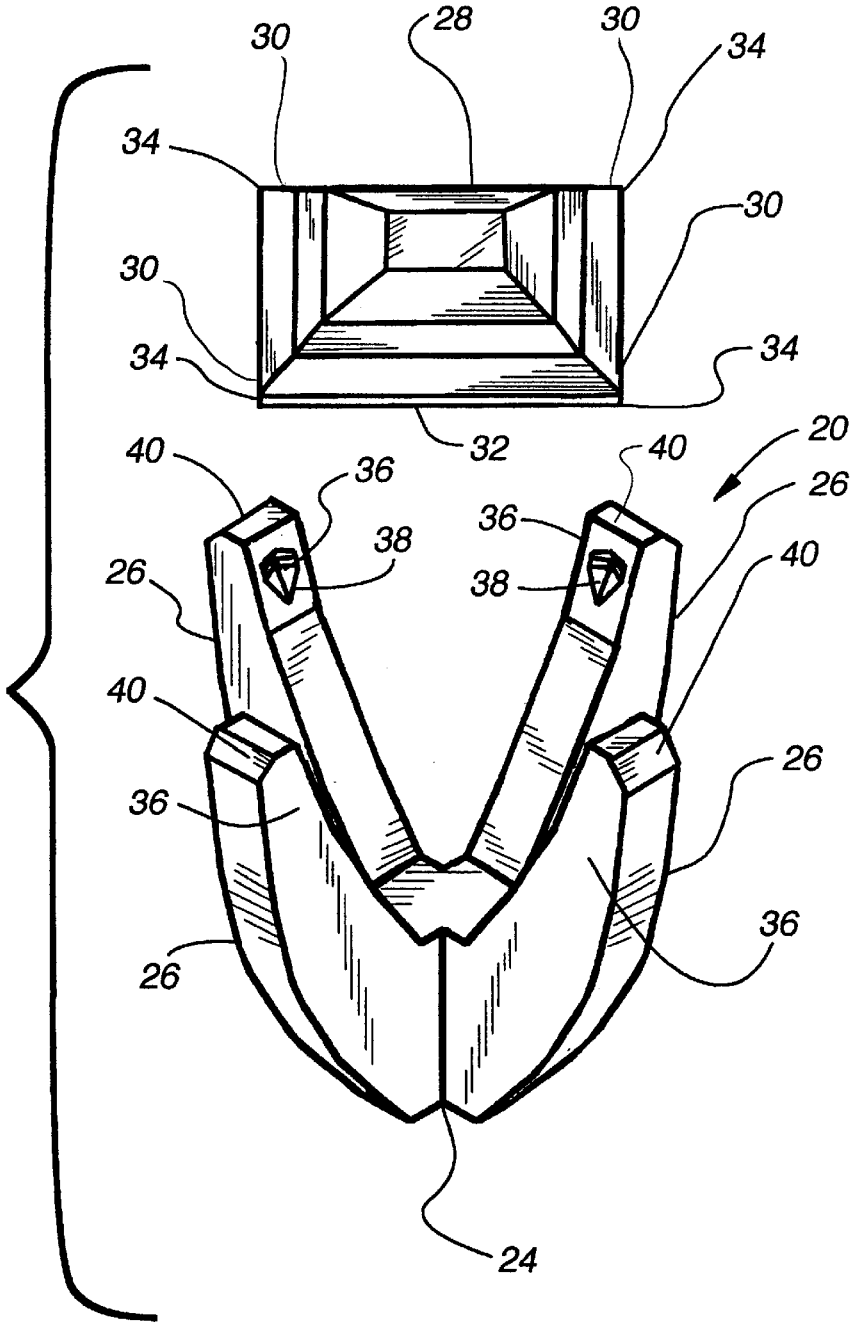
FIG. 2 illustrates an isometric exploded view of the jewelry setting and gem.

FIG. 2 shows an exploded view of a jewelry setting 20 and gem 28. The gem 28 is cut in a princess style having a square shape with four corners 30 and a peripheral edge 32, or girdle, circumscribing the gem 28. The ends of each gem corner 30 form a gem tip 34. The gem 28 is crystalline in structure, with faceted sides forming a geometric pattern. The gem tips 34 also have faceted sides sloped according to the gem's cut and lattice angles.

The jewelry setting 20 is constructed to secure the gem 28. The four tip prongs 26 extend outwardly from the base 24 at an inclined angle and receive the four gem tips 34. It is contemplated that other prong shapes known in the art may be utilized with the present invention. For example, the prongs may have an inclined portion and a vertical portion extending from the base. The top portions 36 of the tip prongs 26 define an area enclosing the gem 28, and contain jewel cavities 38 which receive the gem tips 39. The top portions 36 of the tip prongs also include an outer corner 40 which is chamfered at an angle.

Each jewel cavity 38 is faceted to match the gem tip's crystalline structure, with the walls of the cavity 38 angled to fit the faceted sides of the gem tip 34. As the gem 28 is seated in the jewelry setting 20, the cavities in the tip prongs 26 receive the gem tips 34. The sides of the gem tips 34 make contact with the faceted walls of the cavities 38. The gem tips 34 are secured inside the cavities 38 by applying a force at the outer chamfered corners 40 of the tip prongs 26 directed inwardly towards the base 24. This causes the cavity walls to engage and embrace the sides of the gem tips 34 and helps clamp the gem 28 in the jewelry setting 20.

Figure 3:
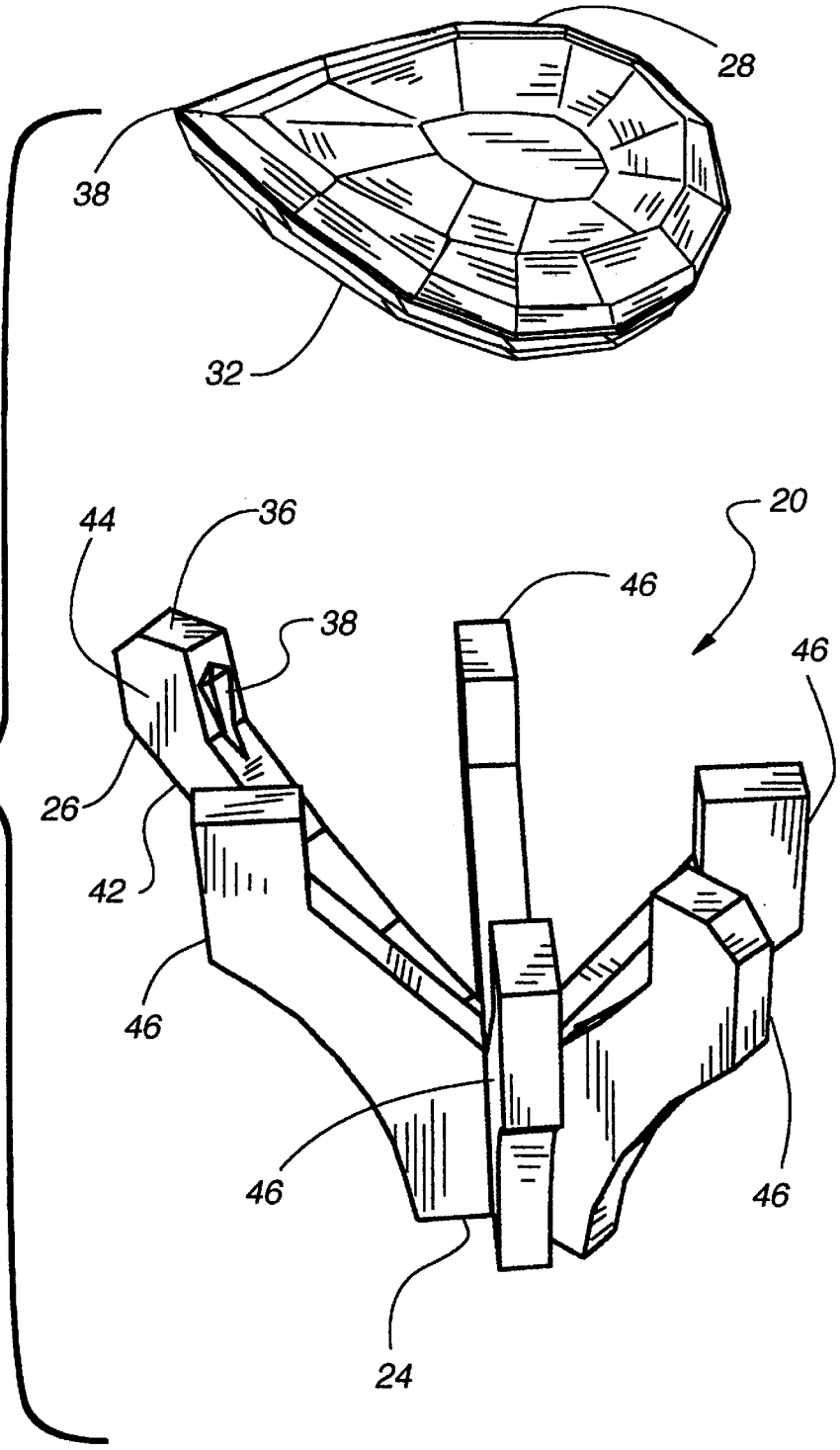
FIG. 3 shows an exploded view of another embodiment of the jewelry setting formed to secure a gem having a pear-shaped cut.

FIG. 3 shows an exploded view of another embodiment of the jewelry setting 20 formed to secure a gem 28 having a pear-shaped cut. Since the pear-shaped gem cut generally produces a gem with only one tip 34, only a single tip prong 26 is utilized in the setting. The tip prong 26 includes an inclined section 42 and a vertical section 44. A jewel cavity 38 is located in the top portion 36 of the tip prong, in the vertical section 44 and in part along the inclined section 42. The setting also includes side prongs 46 which receive the gem edge 32 and help secure the gem 28 in the setting 20. As previously mentioned, the cavity walls are matched to the faceted sides of the gem tip.

Figure 4:
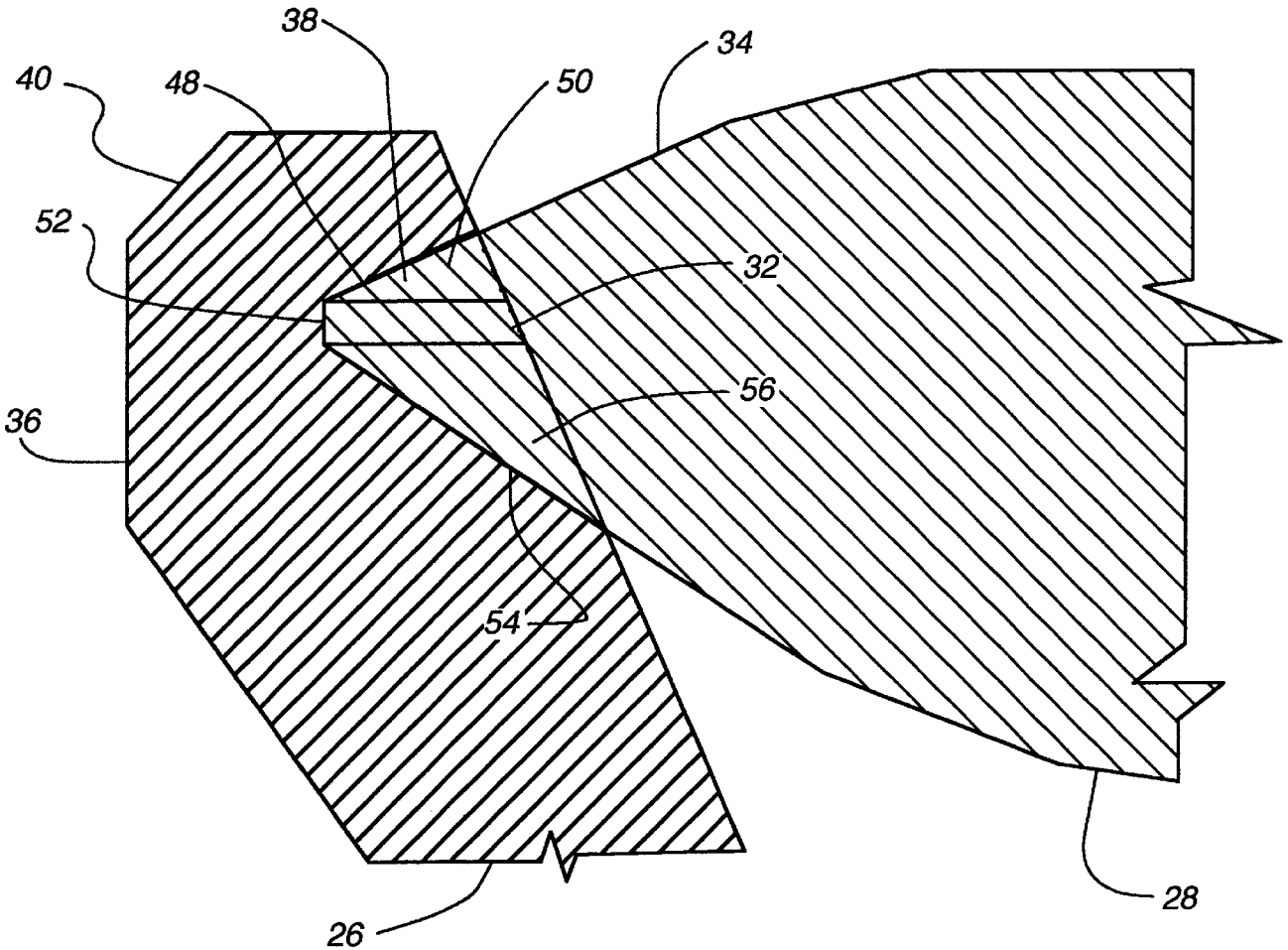
FIG. 4 depicts a cross-sectional view of a tip prong securing a gem tip.

FIG. 4 depicts a cross-sectional view of a tip prong 26 securing a gem tip 34. The top portion 36 of the tip prong 26 includes the jewel cavity 38 and the outer chamfered corner 40. The jewel cavity 38 is patterned to substantially conform to the shape of the gem tip 34. As contemplated by the present invention, a force directed inwardly towards the base (not shown) is applied to the outer corner, causing the cavity walls to bend and mate with the gem tip 34. In this manner, the upper walls 48 of the jewel cavity 38 make contact with the upper sides 50 of the gem 28. Similarly, the side walls 52 of the cavity make contact with the gem edge 32, and the lower cavity 54 walls make contact with the lower gem sides 56. In this way the gem tip is contacted on every faceted surface by the cavity, thus creating a secure engagement.

Figure 5:
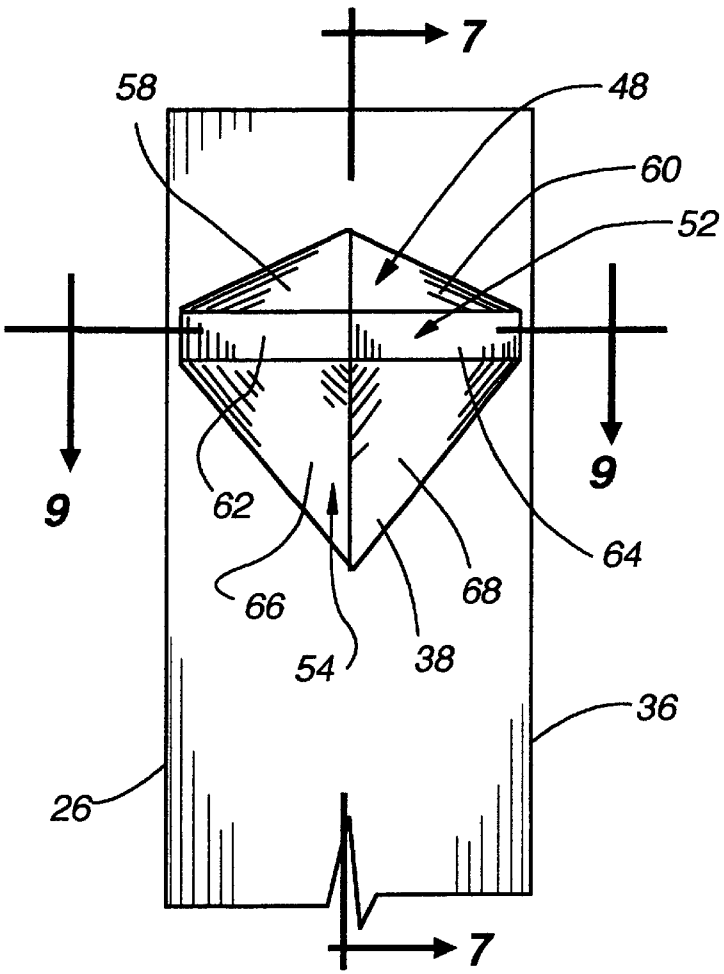
FIG. 5 is a front view of the jewel cavity.

FIG. 5 is a front view of the jewel cavity 38. The cavity 38 is horizontally centered along the tip prong's top portion 36. The cavity 38 includes an upper wall section 48 which includes a left upper wall 58 and a right upper wall 60. A side wall section 52 of the cavity includes a left side wall 62 and a right side wall 64, which are substantially rectangular as shown. In addiction, a lower wall section 54 has a left lower wall 66 and a right lower wall 68. The walls of the jewel cavity 38 are formed to receive the sides of the gem tip 34, such that the jewel cavity conforms to the shape of the gem tip. Preferably, each wall of the jewel cavity 38 is formed to receive and contact a side of the gem tip 34.

Figure 6:
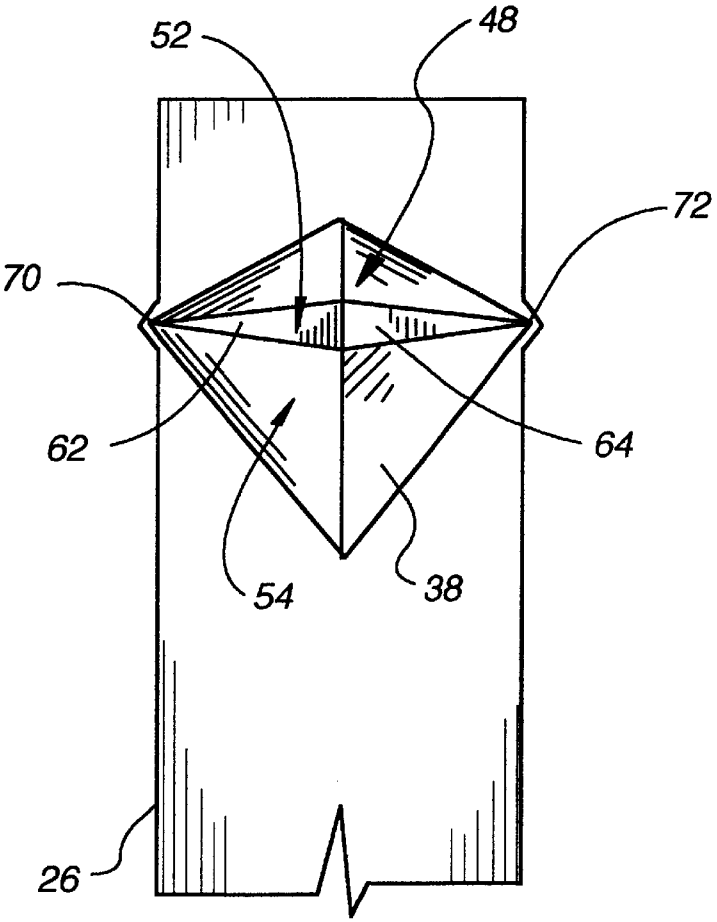
FIG. 6 shows a front view of the jewel cavity after securing a gem.

FIG. 6 shows a front view of the jewel cavity 38 after securing a gem. As previously mentioned, an inwardly directed force is applied to the outer corner of the tip prong 26, causing the prong to secure the gem in the cavity. As force is applied, the upper wall section 48 bends towards the lower wall section 54 of the cavity 38. In addition, the side wall section 52 narrows and extends horizontally. The left side wall 62 generally narrows towards a left cavity edge 70, and the right side wall 64 generally narrows towards a right cavity edge 72. The side wall section 52 thus converges to the left and right cavity edges 70 and 72, causing the cavity 38 to expand horizontally. This may also cause the tip prong 26 to bow outwardly along the cavity edges 70 and 72. Bending the prong in this manner helps secure the gem tip received in the cavity, and allows for adjustments if the cavity is a little larger than the tip. The risk of breaking the gem tip by the present invention is less than prior art structures because the bending force on the tip is spread over a larger surface area, distributing the stress throughout the gem tip.

Figure 7:
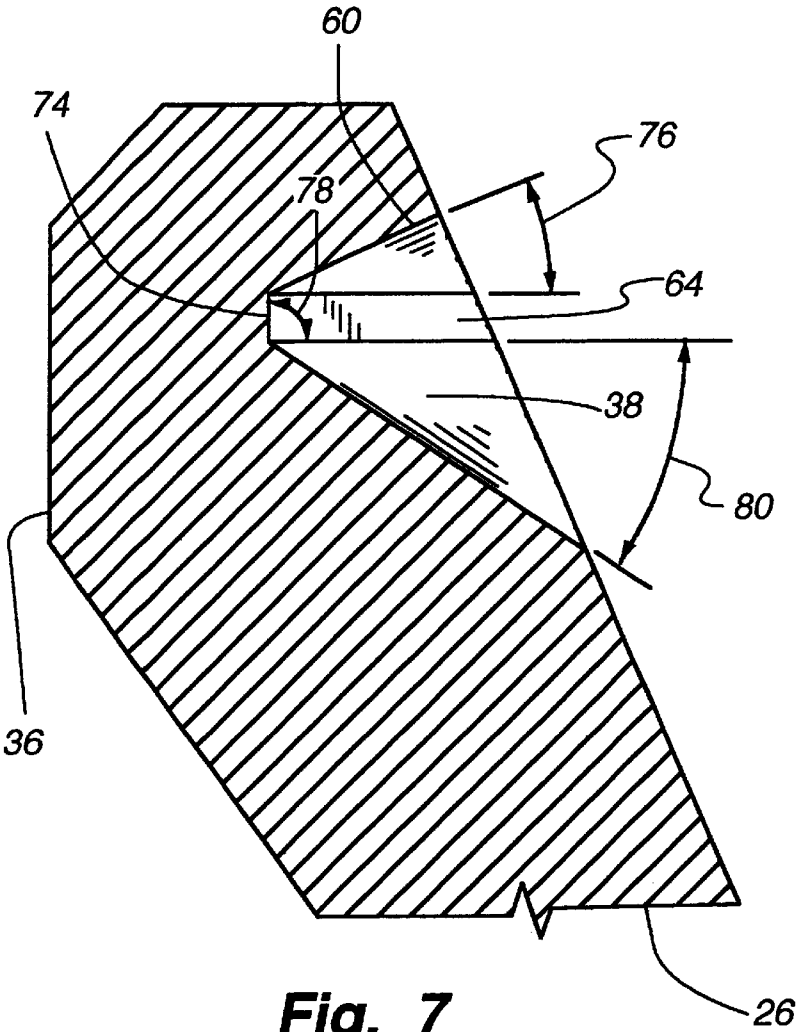
FIG. 7 illustrates a cross sectional view of a jewel cavity taken along the section line 7—7 of FIG. 5.

FIG. 7 illustrates a cross sectional view of a jewel cavity 38 taken along the section line 7—7 of FIG. 5. The jewel cavity 38 contains faceted walls converging at various angles to a cavity end 74 located approximately mid-depth within the top portion 36 of the tip prong 26. As shown, the right upper wall 60 slopes at an upper wall angle 76. Similarly, the right side wall 64 is sloped at a side wall angle 78, and the right lower wall 68 slopes at a lower wall angle 80. The left walls of the jewel cavity 38 are similarly angled according to the shape of the gem tip's left sides. The cavity wall angles are matched to the gem tip lattice angles, thus allowing each of the cavity walls to make contact with the respective gem tip sides when the gem is seated the jewelry setting. It is therefore contemplated that the number of jewel cavity walls and their respective angles will vary according the number of facets and the facet angles of the gem tip to be received by the cavity.

Figure 8:
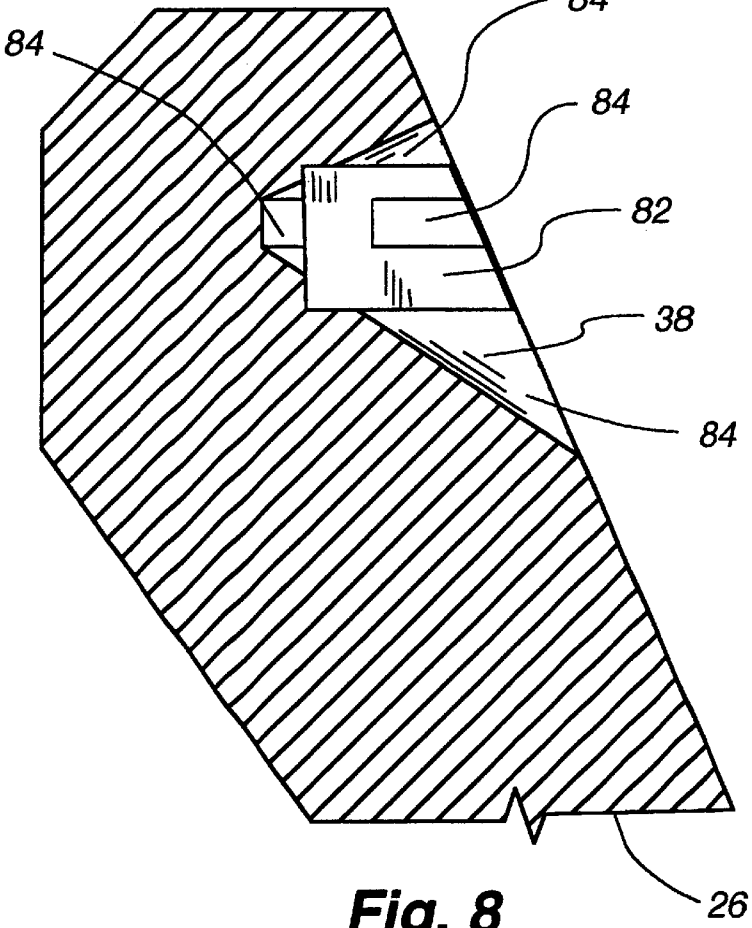
FIG. 8 shows a jewel cavity of the present invention having a cylindrical drilled portion.

It is contemplated that adjustments to the cavity shape can be made by drilling or burring a portion of the jewel cavity. In FIG. 8, a jewel cavity 38 of the present invention is shown having faceted sides and a cylindrical drilled portion 82. The drilled portion 82 can extend the jewel cavity area, allowing the tip prong 26 to seat a gem tip which would normally not fit the jewel cavity 38. After drilling a portion of the jewel cavity 38, faceted walls 84 matched to the gem tip sides continue to make contact with the gem tip as described above. It is contemplated that the drilled portion could be frustoconical, conical, or hemispherical in shape.

Figure 9:
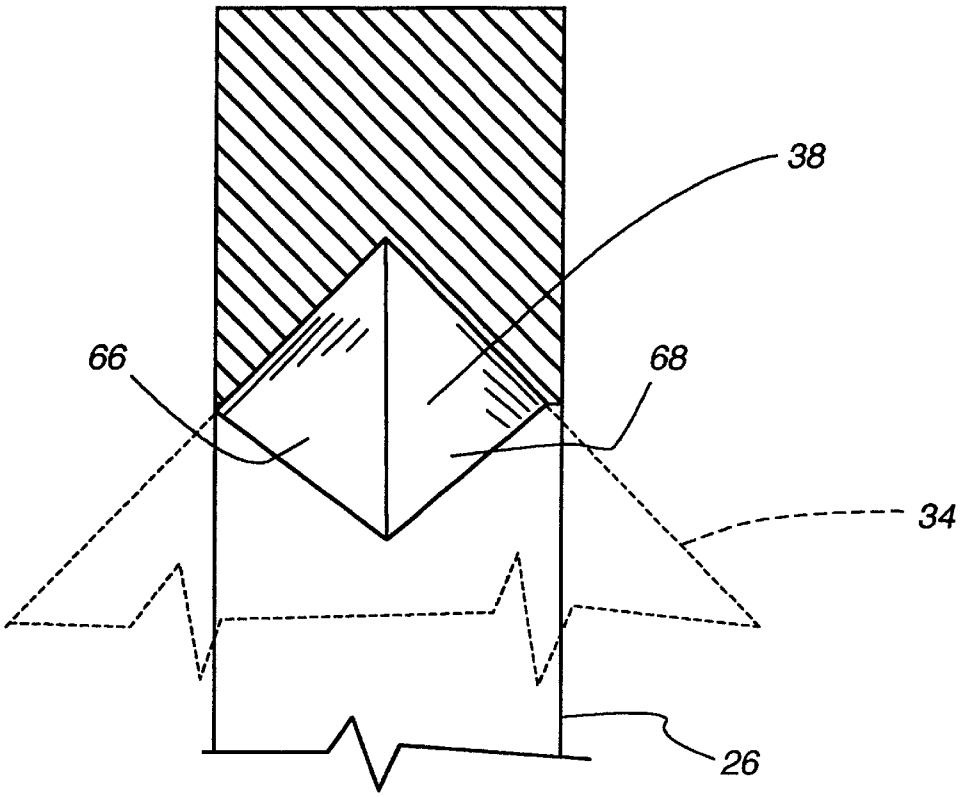
FIG. 9 illustrates a cross sectional view of a jewel cavity taken along the section line 9—9 of FIG. 5.

FIG. 9 illustrates a cross sectional view of a jewel cavity 38 taken along the section line 9—9 of FIG. 5. The lower left and right walls 66 and 68 respectively of the jewel cavity 38 seat the lower sides of the gem tip 34 over a large area of the tip prong 26. This spreads out stress on the gem tip after bending the prongs since more of the gem's surface area makes contact with the tip prong 26.

Referring back to FIG. 2, the gem 28 is received by the jewelry setting 20, within the area bounded by the tops of tip prongs 26. The gem tip 34 is seated in the tip prong's jewel cavity 38, which conforms to the faceted sides of the gem tip 34. Preferably, the tip prong 26 is pushed inwardly at the outer corner 40 to further secure the gem tip 34 inside the cavity 38 with a clamping tool (not shown). The clamping tool applies pressure to the outer corner 40 of the tip prong 26 and thereby squeezing the cavity walls against the gem tip sides seated within the cavity 38. Since the jewel cavity 38 is matched to the gem tip's shape, the inwardly directed force from the tip prong is spread over a relatively large surface area of the gem tip 34. This spreads out the resultant stress over the surface of the gem 28, and helps prevent gem tips 34 from breaking off as they are fastened to jewelry settings.

The jewel cavity of the present invention can help decrease the incidence of gems falling out of the jewel setting. Matching the jewel cavity's faceted walls with the gem tip's faceted sides gives the gem a greater area of contact with the jewelry setting. This increases the likelihood that the gem tip will remain in contact with the tip prong as the jewelry setting loosens over time due to temperature changes and shock from normal use. The increased surface area of contact also reduces the areas of high stress after the prong is bent. Therefore, the increased gem contact with the tip prongs can prevent the gem from slipping out of the jewelry setting at a later time, and helps keep the gem tips from breaking during the mounting process.

The cavity shape is preferably stamped into to the tip prong with a stamping tool having a tip formed as a replica of the gem, or similar style and size of gem, to be positioned in the setting. The jewelry setting contemplated in the present invention can be used to seat gem tips of varying sizes and shapes. Different stamp prints can be made for different size gems with different style cuts. For example, a different stamp can be made for ⅓, ½, ¾, and 1 carat princess, marquise, and pear cut diamonds.

Stamping the jewel cavity helps reduce the time and effort in manufacturing the jewelry setting over traditional boring or drilling techniques. Drilling a jewelry setting requires the manufacturer to insert a drill bit at the interior prong surface. This is not always convenient since other prongs opposite the one to be drilled may block the drill bit's access. The manufacturer may be required to drill around an obstructed prong by repeatedly drilling a cavity from various angles to achieve the desired cavity size and shape. On the other hand, a stamping tool imprint with a faceted cavity shape can be positioned easily within the jewelry setting, with little or no obstruction from other prongs in the setting. Thus, stamping a faceted cavity on a tip prong reduces the time needed to manufacture the jewelry setting of the present invention. If necessary for a particular application, the cavity can be modified by additional drilling.

Although the preceding discussion and drawings of the present invention was limited to a gem with a princess-shaped cut and a pear-shaped cut, it will be understood by those skilled in the art that the jewelry setting can seat other gem cut styles. For example, it is contemplated that the jewelry setting can receive a marquise cut gem by configuring two opposite facing tip prongs with faceted cavities matched to receive marquise cut gem tips.

Accordingly, as shown and described above, the present invention can be used to secure a stone within a jewelry setting. The jewelry setting can be attached to rings, earrings, necklaces, or other types of jewelry. It is understood that the jewelry setting can be used in other applications to secure stones therein. For instance, the jewelry setting can be attached to drilling or etching machines which use diamonds or other stones to condition hard surfaces.

While the invention has been particularly shown and described with reference to a preferred embodiment thereof, it will be understood by those skilled in the art that various other changes in the form and details may be made without departing from the spirit and scope of the invention.

What is claimed is:

1. A jewelry setting for seating a stone, the stone having at least one peripheral tip, said jewelry setting comprising:

a base;

a plurality of prongs branching outwardly from said base;

a cavity in at least one of said prongs, said cavity adapted to receive the peripheral tip of the stone, said cavity including an upper section, a side section, and a lower section;

said side section formed by at least one substantially rectangular wall;

said upper section located above said side section and formed by at least one substantially triangular wall; and said lower section located below said side section and formed by at least one substantially triangular wall.

2. The jewelry setting of claim 1, wherein a top portion of at least one of said prongs defining said cavity has a chamfered outer corner.

3. The jewelry setting of claim 1, wherein a portion of said cavity is curved.

4. The jewelry setting of claim 1, wherein a portion of said cavity is cylindrical in shape.

5. The jewelry setting of claim 1, wherein at least one of said prongs having said cavity further comprises an inclined portion and a vertical portion, said inclined portion attached to said base at one end and extending outwardly at an angle from said base, and said inclined portion having another end connected to said vertical portion; and wherein said cavity is positioned at least in said vertical portion.

6. The jewelry setting of claim 5, wherein said cavity is positioned at least in part in said inclined portion.

7. The jewelry setting of claim 6, wherein said inclined portion is adapted to receive the peripheral tip of the stone.

8. The jewelry setting of claim 1, wherein said side section is V-shaped, said side section including a first rectangular wall and a second rectangular wall engaging along a common edge.

9. The jewelry setting of claim 1, wherein said upper section is sloped downwardly and engages said side section at an obtuse angle relative to said substantially rectangular wall of said side section, and said lower section is sloped upwardly and engages said side section at an obtuse angle relative to said substantially rectangular wall of said side section.

10. A jewelry setting for seating a stone, the stone having at least one peripheral tip, said jewelry setting comprising:

a base;

a plurality of prongs, said prongs having an inclined portion extending from said base outwardly at an angle, and said prongs having a vertical portion projecting vertically from said inclined portion;

a cavity in at least one of said prongs, said cavity adapted to receive the peripheral tip of the stone, said cavity including an upper section, a side section and a lower section, said cavity positioned in part on said inclined portion and in part on said vertical portion;

said side section formed by at least one substantially rectangular wall;

said upper section located above said side section and formed by at least one substantially triangular wall; and said lower section located below said side section and formed by at least one substantially triangular wall.

11. The jewelry setting of claim 10, wherein a top portion of at least one of said prongs defining said cavity has a chamfered outer corner.

12. The jewelry setting of claim 10, wherein a portion of said cavity is curved.

13. The jewelry setting of claim 10, wherein a portion of said cavity is cylindrical in shape.

14. A jewelry setting for seating a stone, the stone having at least one peripheral tip, said jewelry setting comprising:

a base;

a plurality of prongs, said prongs having an inclined portion extending form said base outwardly at an angle, and said prongs having a vertical portion projecting vertically from said inclined portion;

a cavity in at least one of said prongs, said cavity adapted to receive the peripheral tip of the stone, and said cavity including an upper section, a side section, and a lower section, said cavity positioned in part on said inclined portion and in part on said vertical portion;

said side section formed by at least one substantially rectangular wall;

said upper section located above said side section and formed by a first upper triangular wall and a second upper triangular wall engaging along a common edge, said first and second upper triangular walls slanted downwardly and engaging said side section; and said lower section formed by at least one substantially triangular wall.

15. A jewelry setting for seating a stone, the stone having at least one peripheral tip, said jewelry setting comprising:

a base;

a plurality of prongs, said prongs having an inclined portion extending form said base outwardly at an angle, and said prongs having a vertical portion projecting vertically from said inclined portion;

a cavity in at least one of said prongs, said cavity adapted to receive the peripheral tip of the stone, and said cavity including an upper section, a side section, and a lower section, said cavity positioned in part on said inclined portion and in part on said vertical portion;

said side section formed by at least one substantially rectangular wall;

said upper section located above said side section and formed by at least one substantially triangular wall; and said lower section formed by a first lower triangular wall and a second lower triangular wall engaging along a common edge, said first and second lower triangular walls slanted upwardly and engaging said side section.

* * * * *